US007004462B2

(12) United States Patent
Bryer

(10) Patent No.: US 7,004,462 B2
(45) Date of Patent: Feb. 28, 2006

(54) PRINT MEDIA GUIDE SYSTEM

(75) Inventor: Philip Bryer, Tarzana, CA (US)

(73) Assignee: ZIH Corp., Hamilton (BM)

( * ) Notice: Subject to any disclaimer, the term of this patent is extended or adjusted under 35 U.S.C. 154(b) by 276 days.

(21) Appl. No.: 10/350,970

(22) Filed: Jan. 23, 2003

(65) Prior Publication Data

US 2003/0141655 A1 Jul. 31, 2003

Related U.S. Application Data

(60) Provisional application No. 60/351,813, filed on Jan. 25, 2002.

(51) Int. Cl.
*B65H 9/00* (2006.01)

(52) U.S. Cl. ..... 271/171; 271/145; 271/223; 400/633; 400/642

(58) Field of Classification Search ..... 271/145, 271/171, 223; 400/642, 633, 633.1, 633.2; 74/422

See application file for complete search history.

(56) References Cited

U.S. PATENT DOCUMENTS

| | | | | |
|---|---|---|---|---|
| 2,250,025 | A | 7/1941 | Klein | |
| 3,971,280 | A | 7/1976 | Inka | |
| 4,105,168 | A | 8/1978 | Rutherford | |
| 4,248,391 | A | 2/1981 | Ness | |
| 4,652,317 | A | 3/1987 | Seestrom | |
| 4,738,176 | A * | 4/1988 | Cassia | 83/208 |
| 4,913,367 | A | 4/1990 | Hata | |
| 4,948,064 | A | 8/1990 | Richard | |
| 5,025,998 | A | 6/1991 | Hutzenlaub et al. | |
| 5,472,153 | A | 12/1995 | Crowley et al. | |
| 5,483,624 | A | 1/1996 | Christopher et al. | |
| 5,486,259 | A | 1/1996 | Goodwin et al. | |
| 5,594,838 | A | 1/1997 | Christopher et al. | |
| 5,788,384 | A | 8/1998 | Goodwin et al. | |
| 5,805,779 | A | 9/1998 | Christopher et al. | |
| 5,813,343 | A | 9/1998 | Harb | |
| 5,833,377 | A | 11/1998 | Keller et al. | |
| 5,833,800 | A | 11/1998 | Goodwin et al. | |
| 5,836,205 | A * | 11/1998 | Meyer | 74/89.17 |
| 5,927,702 | A * | 7/1999 | Ishii et al. | 271/9.09 |
| 6,158,342 | A | 12/2000 | Moore | |
| 6,163,538 | A | 12/2000 | Brown et al. | |
| 6,164,203 | A | 12/2000 | Keller | |
| 6,283,422 | B1 * | 9/2001 | Stoelinga | 248/188.2 |
| 6,302,604 | B1 | 10/2001 | Bryant et al. | |
| 6,386,775 | B1 | 5/2002 | Hamisch et al. | |
| 6,431,492 | B1 | 8/2002 | Chillscyzn | |
| 6,503,008 | B1 | 1/2003 | Zevin et al. | |
| 6,533,476 | B1 | 3/2003 | Hamisch, Jr. et al. | |
| 6,607,316 | B1 | 8/2003 | Petteruti et al. | |
| 6,609,844 | B1 | 8/2003 | Petteruti et al. | |
| 6,622,622 | B1 | 9/2003 | Lee et al. | |

(Continued)

FOREIGN PATENT DOCUMENTS

JP 2004009232 A * 1/2004

(Continued)

*Primary Examiner*—Patrick Mackey
(74) *Attorney, Agent, or Firm*—Alston & Bird LLP

(57) ABSTRACT

A rack-and-pinion print media guide system comprises two racks which are operatively coupled for reciprocal movement relative to each other by way of a central gear cluster instead of a single central gear (pinion) to expand the maximum media capture range. The gear cluster comprises first and second pinions and at least one center idler gear which is operatively coupled between the pinions with each rack skipping the center idler gear during operation.

22 Claims, 9 Drawing Sheets

U.S. PATENT DOCUMENTS

| | | | |
|---|---|---|---|
| 6,695,500 | B1 | 2/2004 | Kim et al. |
| 6,712,112 | B1 | 3/2004 | Goodwin |
| 6,796,234 | B1 | 9/2004 | Busshoff |
| 6,805,183 | B1 | 10/2004 | Goodwin |

FOREIGN PATENT DOCUMENTS

| | | | |
|---|---|---|---|
| JP | 2004352463 | A | * 12/2004 |

* cited by examiner

PRINT MEDIA GUIDE SYSTEM

RELATED APPLICATIONS

The present application claims the benefit of U.S. provisional patent application, Ser. No. 60/351,813, filed Jan. 25, 2002, by the same inventor, and having the same Assignee, the disclosure of which is incorporated herewith in its entirety by reference.

FIELD OF THE INVENTION

The present invention relates generally to print media guide systems and more particularly to a rack-and-pinion print media guide system which incorporates a central gear cluster instead of a single central gear (pinion) to expand the maximum media capture range.

BACKGROUND OF THE INVENTION

Printers are typically required to handle print media of various widths. Lateral alignment of print media across the print head may be accomplished by one of two means: (a) a single edge-justified means, in which regardless of the print media width, one edge of the print media occupies the same position across the print head, or (b) a center-justified means, in which regardless of the print media width, the center of the print media always aligns with the center of the print head. The latter is generally preferred by printer manufacturers from a mechanical standpoint as it provides better media tracking, more even pressure, and the like.

FIGS. 1–2 schematically illustrate a conventional center-justified media guide holder setup in which two opposing print media guide members 10, 12 are operatively coupled via integral racks 16, 18, respectively, and a single central pinion 14. Each rack is provided on one side with a plurality of teeth which mesh with a corresponding set of teeth on central pinion 14. Print media guide members 10, 12 are adapted to move in a reciprocal linear fashion relative to each other to afford a range of print media widths. Typical minimum/maximum media widths (capture ranges) may be, for example, 1 inch and 1.875 inch, respectively, as generally shown in FIGS. 1–2. Pinion 14 is adapted to rotate on a fixed post 20 (FIGS. 1–2) which is mounted centrally between print media guide members 10, 12 on a printer frame (not shown).

In any given design there will be a minimum and a maximum media capture range for the purpose of accommodating a range of media widths. In portable printers, design options are substantially influenced by available space which is minimal due to the need to make the printer as small as possible. It would be desirable to increase the maximum media capture range to accommodate wider media without making substantial modifications to the overall printer design.

SUMMARY OF THE INVENTION

The present invention is generally directed to a media guide system which comprises a first rack, a second rack disposed opposite the first rack with the first and second racks adapted to move in a reciprocal fashion relative to each other to afford a maximum media capture range, and at least one central gear cluster operatively coupled between the first and second racks to expand the maximum media capture range.

BRIEF DESCRIPTION OF THE DRAWINGS

The present invention is generally shown by way of example in the accompanying drawings in which.

DETAILED DESCRIPTION OF THE PREFERRED EMBODIMENTS

Hereinafter, some embodiments of the present invention will be described in detail with reference to the related drawings of FIGS. 1–17. Additional embodiments, features and/or advantages of the invention will become apparent from the ensuing description or may be learned by practicing the invention.

The drawings are not to scale with like numerals referring to like features throughout both the drawings and the description.

The following description includes the best mode presently contemplated for carrying out the invention. This description is not to be taken in a limiting sense, but is made merely for the purpose of describing the general principles of the invention.

Figure 3:
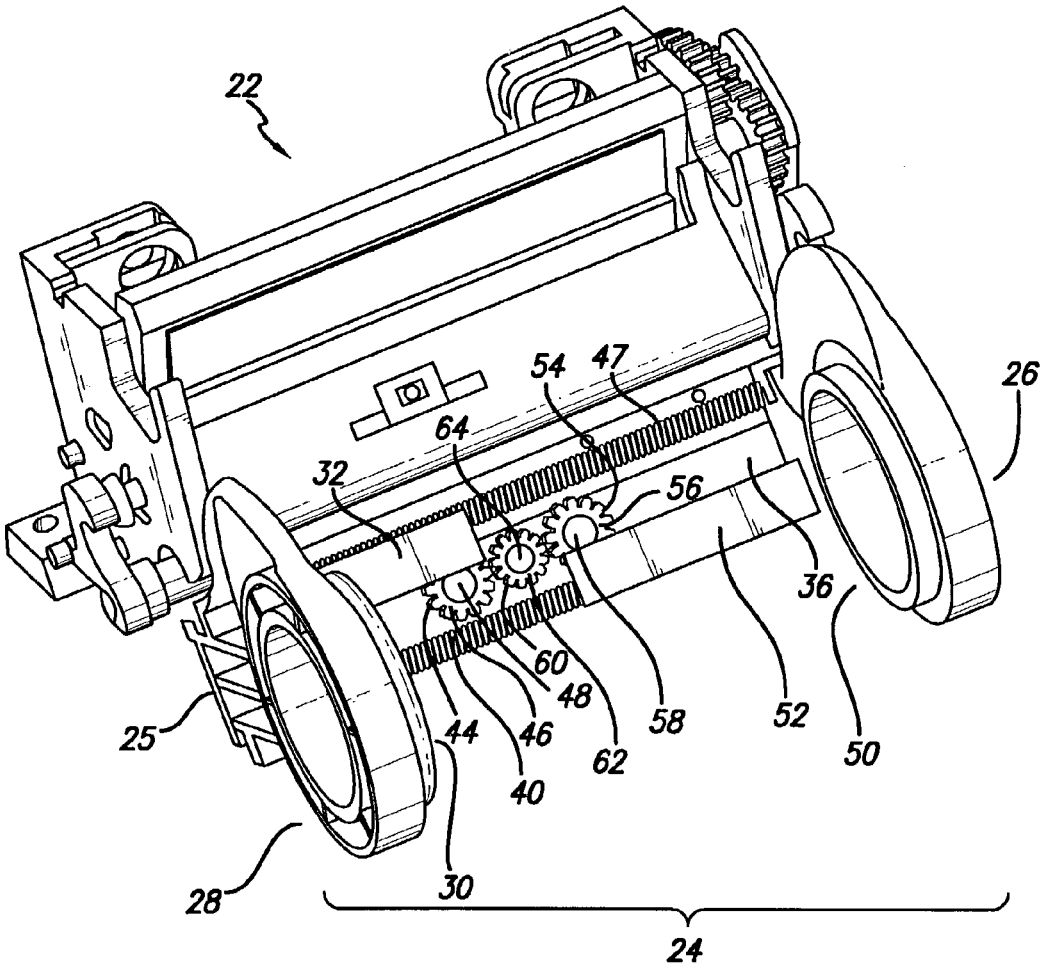
FIG. 3 is a front perspective view of a print mechanism assembly including a three-gear rack-and-pinion media guide system in accordance with one embodiment of the present invention.
Figure 12:
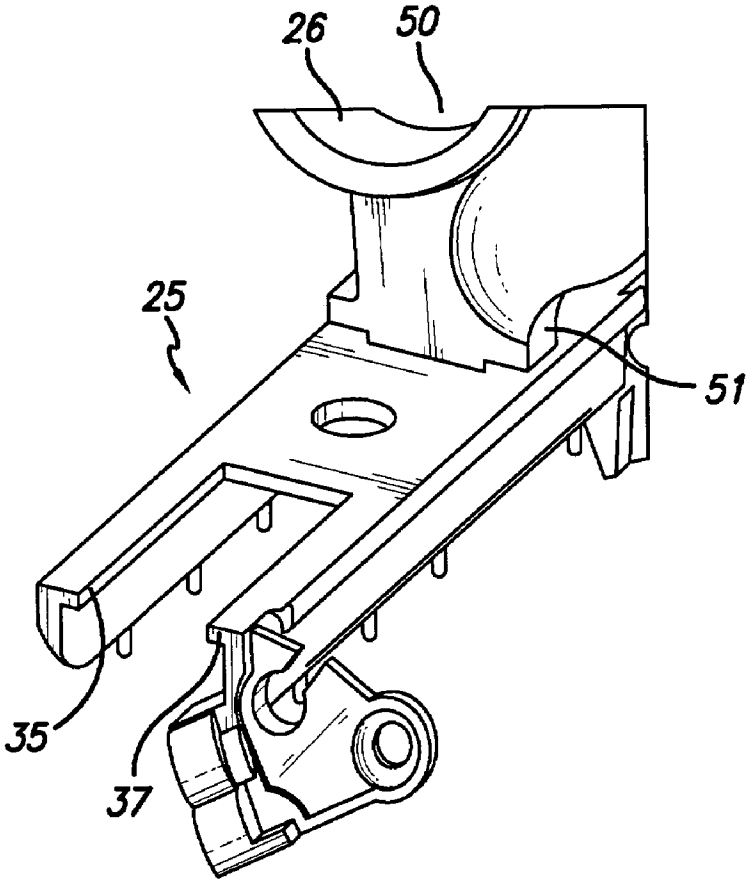
FIG. 12 is a partial perspective view of the track rails of FIG. 11 in accordance with one embodiment of the present invention.
Figure 11:
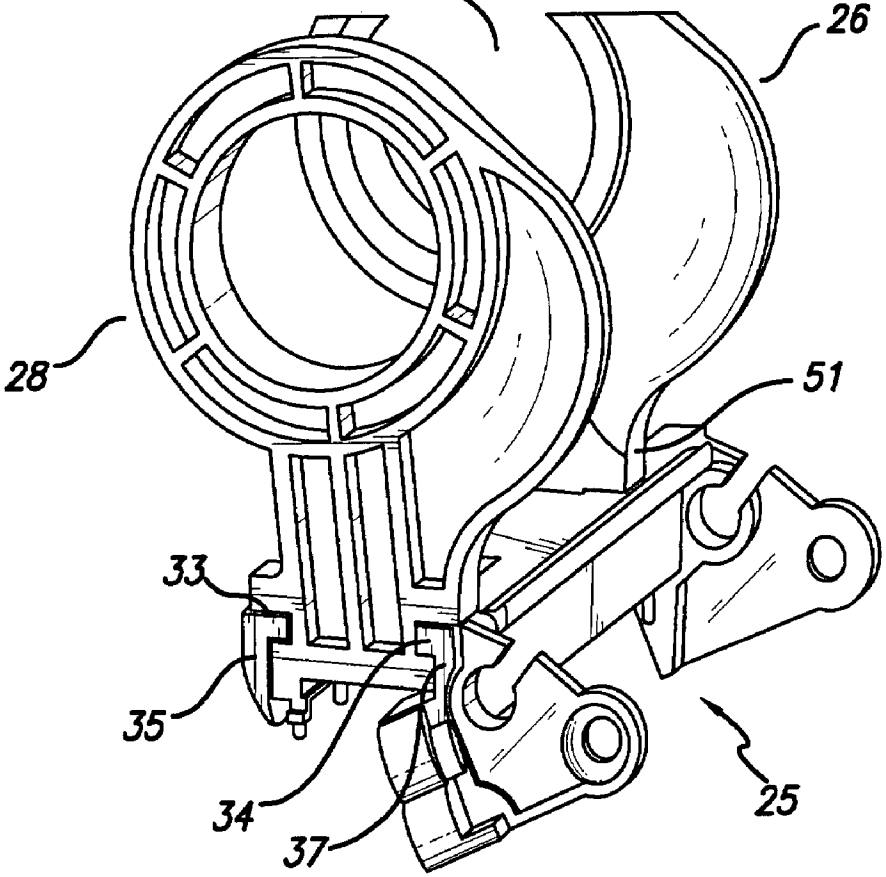
FIG. 11 is a side perspective view of the print media guide member of FIGS. 5A–5C being slidably coupled to a pair of track rails in accordance with one embodiment of the present invention.

Turning to FIG. 3, a print mechanism assembly 22, which may be used, for example, in a direct thermal printer, includes a rack-and-pinion print media guide system 24 comprising two opposing print media guide members 26, 28 which are operatively coupled via generally elongated integral racks 52, 32, respectively, and a central gear cluster instead of a single central gear (pinion) to expand the maximum media capture range, in accordance with a preferred embodiment of the present invention. In accordance with one embodiment of the present invention, the gear cluster comprises first pinion 46, center idler gear 62, and second pinion 56, with all three gears operatively connected, as generally depicted in FIG. 3. Each print media guide member (26, 28) may be spring-loaded (FIG. 3) and adapted to slide on a base frame 25 (FIG. 3) of print mechanism assembly 22, as generally illustrated in FIGS. 11–12. Print media guide members (26, 28) are adapted to move in a reciprocal linear fashion relative to each other to afford a range of print media capture widths.

Figure 13:
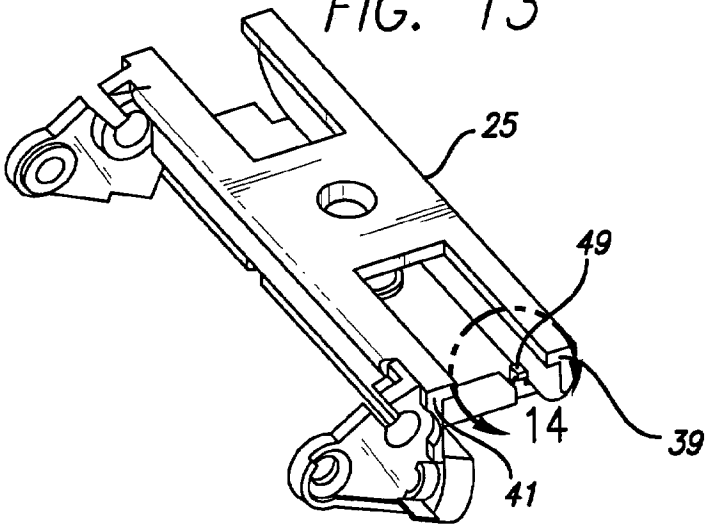
FIG. 13 is a partial perspective view of a print mechanism base frame equipped with first means for coupling an extension spring in accordance with one embodiment of the present invention.
Figure 14:
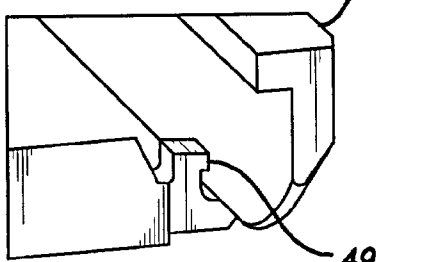
FIG. 14 is an exploded perspective view of the first spring coupling means of FIG. 13.
Figure 17:
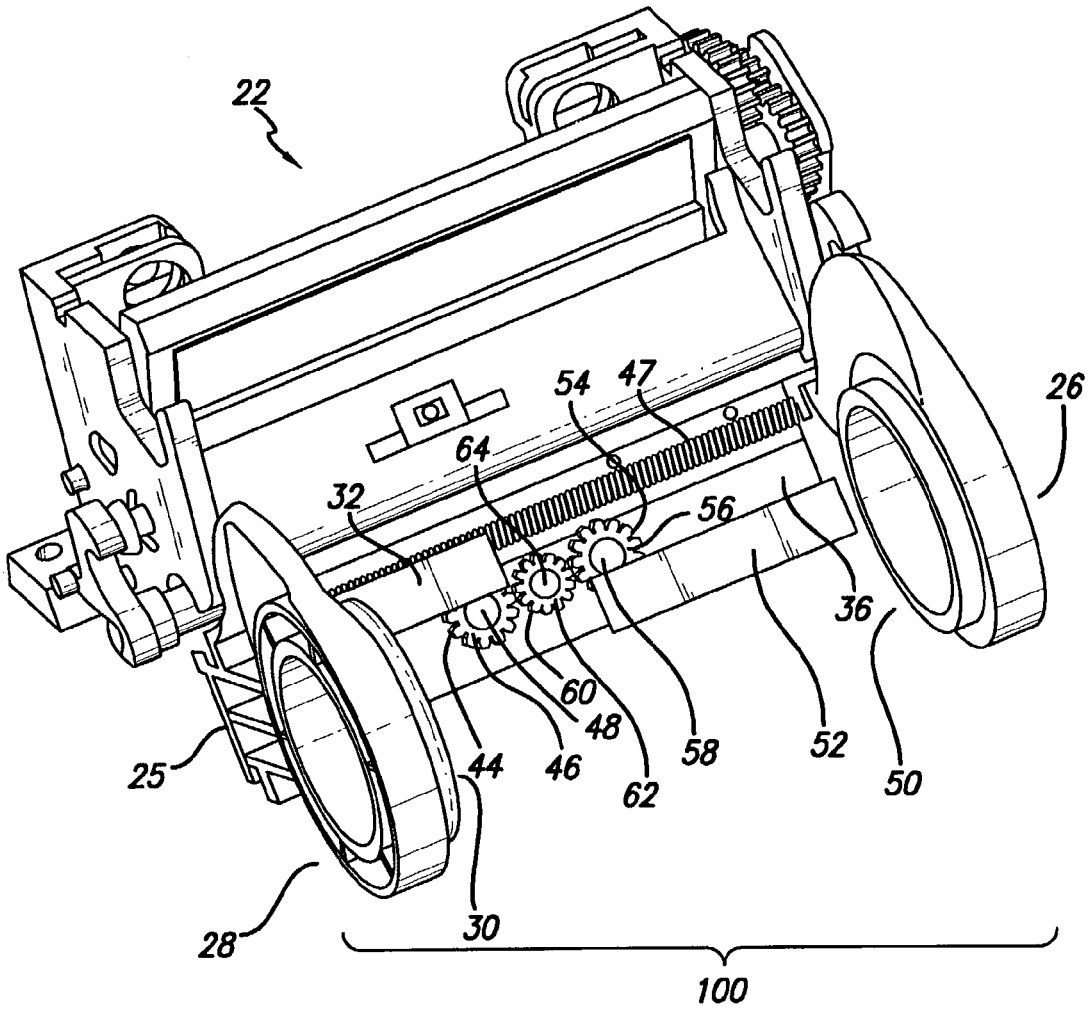
FIG. 17 is a front perspective view of a print mechanism assembly including a three-gear rack-and-pinion media guide system being spring loaded by a single extension spring in accordance with an alternative embodiment of the present invention.

Specifically, print media guide member 28 comprises a media roll holder portion 30 adapted on one side to removably fit within the hollow core of a print media roll, as generally shown in FIGS. 3, 5A–5C, to provide support for a mounted media roll, and a base portion 27 which provides support for integral rack 32 and media roll holder portion 30. Print media guide member 28 is preferably adapted to slide back and forth on base frame 25 of print mechanism assembly 22 via a pair of oppositely disposed notches 33, 34 (on its base portion 27, FIGS. 5A–5C) which slidably receive a corresponding pair of track rails 35, 37 (FIGS. 11–12) on base frame 25 of print mechanism assembly 22. Base portion 27 may also include an integral hook 38 (FIGS. 5A–5C) disposed proximate to integral rack 32 for attaching one end of an extension spring 47 (FIG. 3) which is coupled at the other end to base frame 25 (FIG. 3) of print mechanism assembly 22 via a hook 49 (FIGS. 13–14).

Figure 5A:
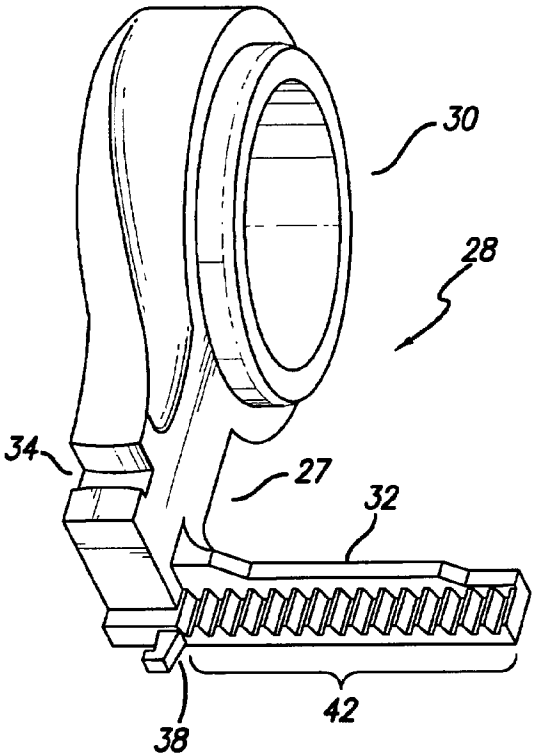
FIG. 5A is a bottom perspective view of a print media guide member in accordance with one embodiment of the present invention.
Figure 5B:
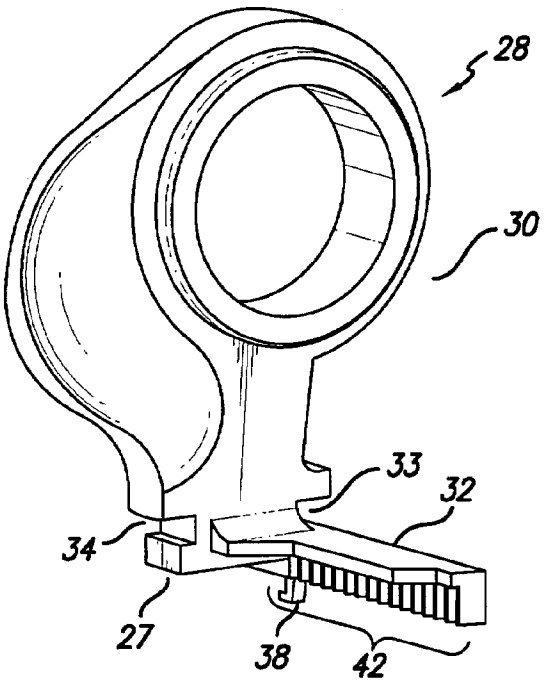
FIG. 5B is a side perspective view of a print media guide member in accordance with one embodiment of the present invention.
Figure 5C:
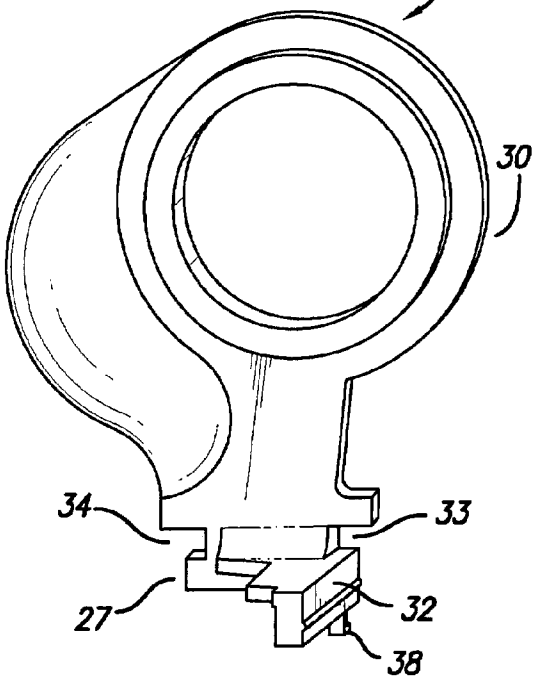
FIG. 5C is a front perspective view of a print media guide member in accordance with one embodiment of the present invention.

Integral rack 32 is generally elongated and has a generally L-shaped cross section (FIGS. 5A–5C). Rack 32 is equipped on one side with a plurality of integral teeth 42 (FIGS. 5A–5B) adapted to mesh with a corresponding set of gear teeth 44 on first pinion 46 which is rotatably mounted on a media guide base 36 (FIG. 3) of print mechanism assembly 22 via a generally cylindrical post fixed 48 (FIG. 3).

Figure 15:
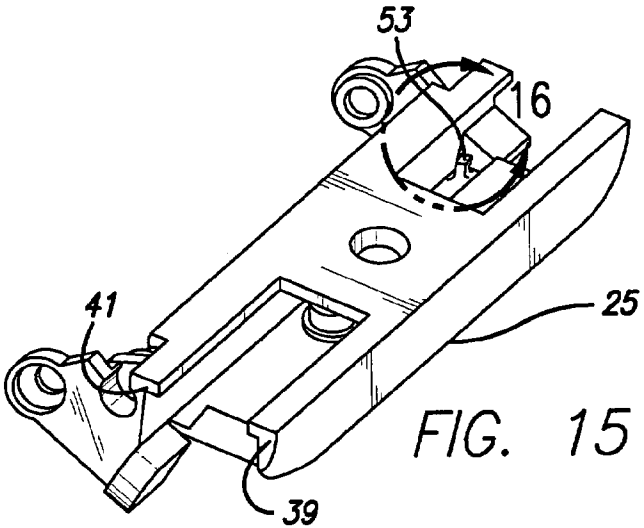
FIG. 15 is a partial perspective view of a print mechanism base frame equipped with second means for coupling an extension spring in accordance with one embodiment of the present invention.
Figure 16:
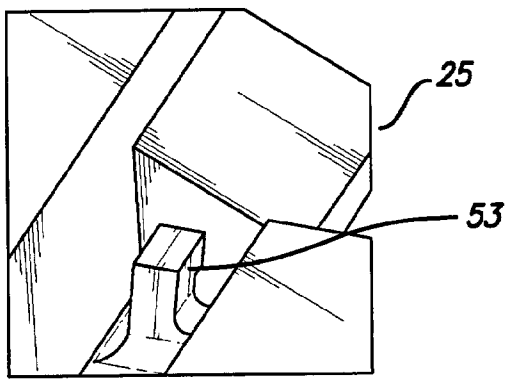
FIG. 16 is an exploded perspective view of the second spring coupling means of FIG. 15.

Print media guide member 26 is essentially of the same construction and form as print media guide member 28. Specifically, print media guide member 26 comprises a media roll holder portion 50 adapted on one side to removably fit within the hollow core of a print media roll, as generally shown in FIGS. 3, 11–12, to provide support for a mounted media roll, and a base portion 51 (FIGS. 11–12) which provides support for integral rack 52 (FIG. 3) and media roll holder portion 50. Print media guide member 26 is preferably adapted to slide back and forth on base frame 25 of print mechanism assembly 22 opposite print media guide member 28 via a pair of oppositely disposed notches on its base portion 51 (notches not shown, but similar to notches 33–34 of FIGS. 5B–5C) which slidably receive a corresponding pair of track rails 39, 41 (FIGS. 13, 15) on base frame 25 of print mechanism assembly 22. Base portion 51 may also include an integral hook (not shown) disposed proximate to integral rack 52 (FIG. 3) for attaching one end of an extension spring 40 (FIG. 3) which is coupled at the other end to base frame 25 (FIG. 3) of print mechanism assembly 22 via a hook 53 (FIGS. 15–16).

A person skilled in the art would readily appreciate that print media guide members 26, 28 may be spring-loaded and/or adapted to slide on base frame 25 (FIG. 3) using alternative means, respectively, provided such alternative means do not depart from the intended purpose and scope of the present invention.

Integral rack 52 is similar in construction and form to rack 32 in accordance with the general principles of the present invention. Specifically, rack 52 is equipped on one side with a plurality of integral teeth (not shown) adapted to mesh with a corresponding set of gear teeth 54 on second pinion 56. Second pinion 56 is rotatably mounted on media guide base 36 (FIG. 3) of print mechanism assembly 22 via a generally cylindrical fixed post 58 (FIG. 3).

Each extension spring (40, 47) has a spring restoring force forcing each of the two opposing media guide members (26, 28), respectively, to move toward the center of media guide base 36 (FIG. 3) in the absence of a print media roll mounted therebetween. The spring restoring force should allow manual spreading of print media guide members 26, 28 (away from each other) to allow the user to mount a print media roll therein.

The gear teeth of each of first and second pinions 46, 56 are adapted to mesh with a corresponding set of gear teeth 60 on a center idler gear 62 which is operatively coupled between first and second pinions 46, 56 to provide for an increased maximum media capture range without the need to modify the overall printer design, in accordance with a preferred embodiment of the present invention. Specifically, idler gear 62 is rotatably mounted on media guide base 36 substantially centrally between print media guide members 26, 28 via a generally cylindrical fixed post 64 (FIG. 3) with first pinion 46, idler gear 62, and second pinion 56 forming a central gear cluster (FIG. 3).

A person skilled in the art would readily appreciate that since the two integral racks (32, 52) are operatively coupled via a central gear cluster, only one extension spring (40 or 47) may be sufficient to spring load the entire rack-and-pinion media guide system 24 in accordance with the general principles of the present invention. In this regard, FIG. 17 generally shows a modified rack-and-pinion media guide system 100 being spring loaded via a single extension spring 47. Such a setup would put less stress on the print media guide members during loading of a print media roll therebetween, as well as offer additional advantages to the manufacturer such as reduction in parts and cost, and ease of assembly.

In accordance with one embodiment of the present invention, center idler gear 62 may be made with a somewhat smaller diameter than the diameter of each of first and second pinions (46, 56) which, in turn, may be substantially of the same diameter, as generally shown in FIG. 3. All three gears (46, 62, 56) are axially aligned on media guide base 36 via fixed posts 48, 64, 58, respectively, to form a generally central three-gear cluster so as to expand the maximum media capture range (relative to the prior art setup of FIGS. 1–2). Variations on this novel setup are generally illustrated in reference to FIGS. 4, 6, 7–8, and 9–10, respectively, and described hereinbelow accordingly.

Figure 1:
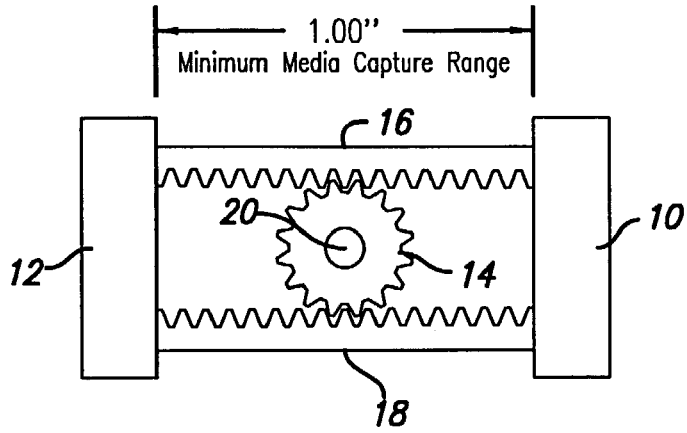
FIG. 1 PRIOR ART
FIG. 1 is a schematic representation of a prior art rack-and-pinion media guide system showing a typical minimum media capture range.
Figure 2:
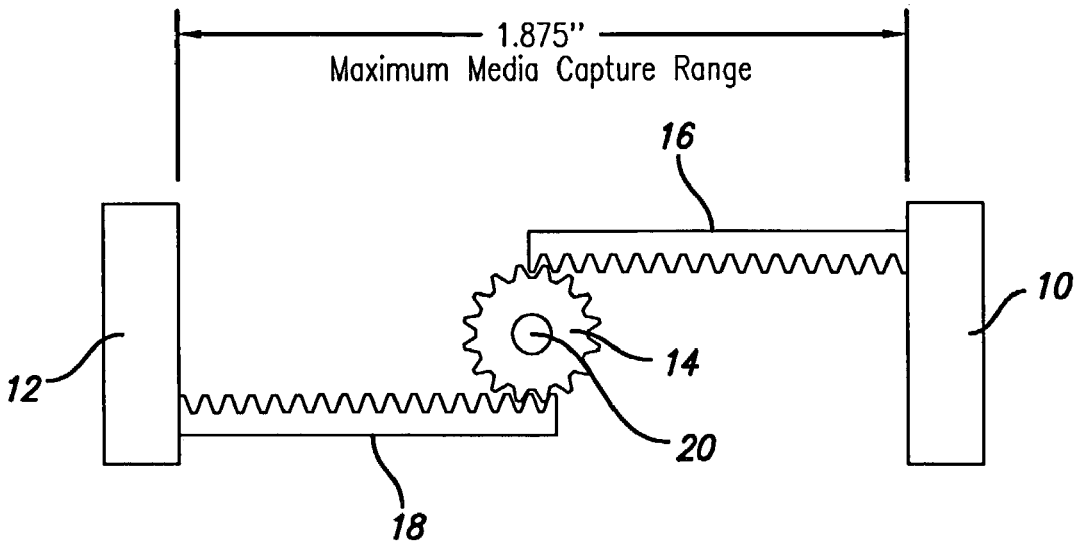
FIG. 2 PRIOR ART
FIG. 2 is a schematic representation of the prior art rack-and-pinion media guide system of FIG. 1 showing a typical maximum media capture range.
Figure 4:
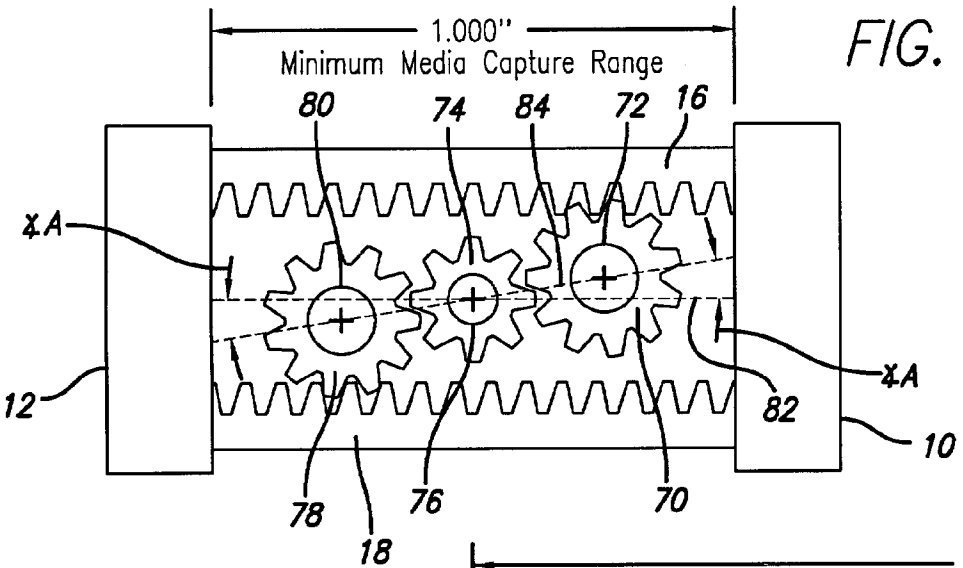
FIG. 4 is a schematic representation of a three-gear rack-and-pinion media guide system showing an exemplary minimum media capture range in accordance with one embodiment of the present invention.
Figure 6:
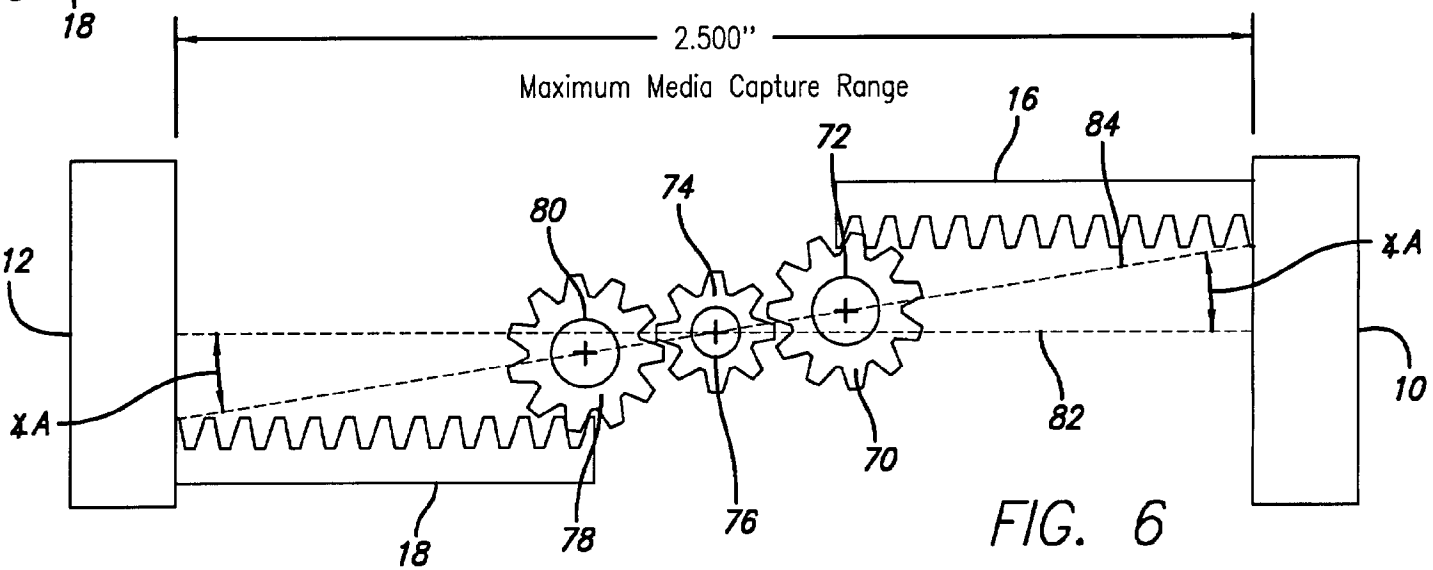
FIG. 6 is a schematic representation of the three-gear rack-and-pinion media guide system of FIG. 4 showing an exemplary maximum media capture range in accordance with one embodiment of the present invention.

Specifically, in accordance with one exemplary embodiment of the present invention, the center-justified media guide holder setup of FIGS. 1–2, may be improved to provide a larger maximum media capture range without the need to modify the overall printer design by replacing single central pinion 14 with a three-gear cluster (of the type shown in FIG. 3) comprising first pinion 78 (which rotates on a fixed post 80), second pinion 70 (which rotates on a fixed post 72), and an idler gear 74 which is rotatably mounted centrally between print media guide members 10, 12 via a fixed post 76, as generally shown in FIGS. 4, 6. To prevent each rack (16, 18) from engaging center idler gear 74, which always rotates in an opposite direction relative to first and second pinions (78, 70), during operation, the diameter of idler gear 74 is made sufficiently smaller than the diameter of each of first and second pinions (78, 70), which are substantially of the same diameter, to allow the three fixed gear posts (80, 76, 72) to be axially aligned in a sloped line configuration, as generally shown in FIGS. 4, 6. Specifically, if an imaginary line 84 (FIGS. 4, 6) were to be drawn through the longitudinal axes (each axis marked with a cross sign, FIGS. 4, 6) of the three gear posts (80, 76, 72), that line would make an acute angle A with an imaginary horizontal line 82 (FIGS. 4, 6) drawn through the longitudinal axis of fixed gear post 76 of center idler gear 74 and being substantially parallel to (elongated) rack 16 and rack 18, as schematically illustrated in FIGS. 4, 6. This type of configuration would result in the longitudinal axis of fixed gear post 80 of first pinion 78 being essentially shifted downwards by angle A and the longitudinal axis of fixed gear post 72 of second pinion 70 being, respectively, shifted upwards by angle A relative to the longitudinal axis of fixed gear post 76 of center gear 74, as schematically illustrated in FIGS. 4, 6. Furthermore, in this sloped line configuration, each rack can only engage its respective pinion during operation, i.e., rack 16 can only engage second pinion 70, and rack 18 can only engage first pinion 78, respectively, with each rack skipping center idler gear 74, as generally depicted in FIGS. 4, 6.

As generally shown in FIG. 6, the new (increased) maximum media capture range for this setup is about 2.5 inch which corresponds to a 33.33% increase in maximum media guide capture range relative to the conventional setup of FIG. 2. A person skilled in the art would readily recognize that other maximum media capture ranges may be achieved depending on application. A person skilled in the art should recognize that first and second pinions (78, 70) do not necessarily have to be of the same diameter with gear diameter size being generally dependent on the particular application.

Figure 7:
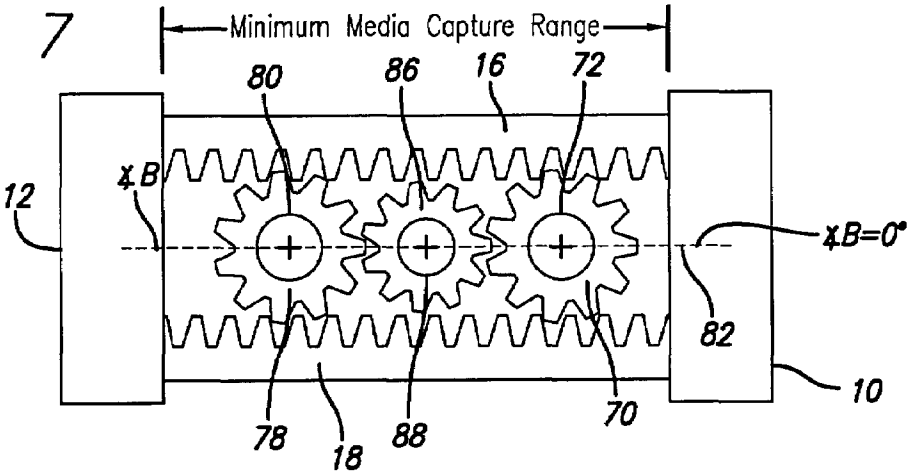
FIG. 7 is a schematic representation of a three-gear rack-and-pinion media guide system showing a minimum media capture range in accordance with an alternative embodiment of the present invention.
Figure 8:
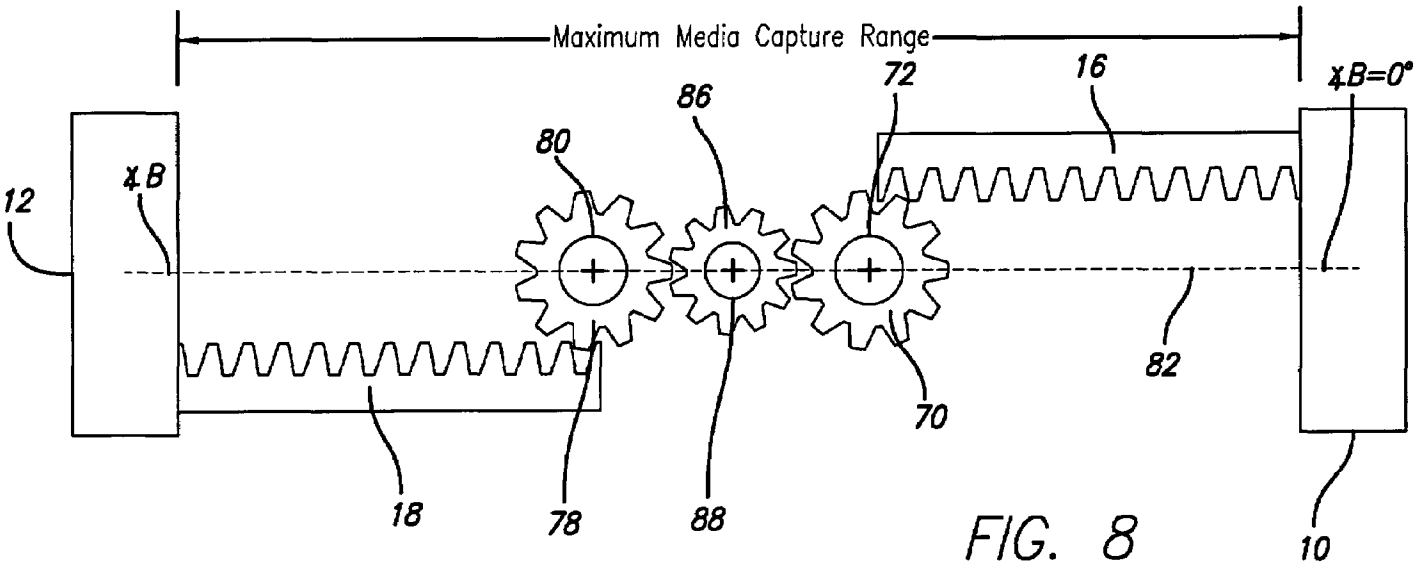
FIG. 8 is a schematic representation of the three-gear rack-and-pinion media guide system of FIG. 7 showing a maximum media capture range.

In accordance with another exemplary embodiment of the present invention, the center-justified media guide holder setup of FIGS. 1–2, may be improved to provide a larger maximum media capture range without the need to modify the overall printer design by replacing single central pinion 14 with a three-gear cluster (similar to the gear cluster of FIG. 3) comprising first pinion 78 (which rotates on a fixed post 80), second pinion 70 (which rotates on a fixed post 72), and an idler gear 86 which is rotatably mounted centrally between print media guide members 10, 12 via a fixed post 88, as generally shown in FIGS. 7–8. To prevent each rack (16, 18) from engaging center idler gear 86, which always rotates in an opposite direction relative to first and second pinions (78, 70), during operation, the diameter of idler gear 86 is made sufficiently smaller than the diameter of each of first and second pinions (78, 70), which are substantially of the same diameter, to allow the three fixed gear posts (80, 88, 72) to be axially aligned in a straight line (zero slope) configuration, as generally shown in FIGS. 7–8. Specifically, if an imaginary line were to be drawn through the longitudinal axes (each axis marked with a cross sign, FIGS. 7–8) of the three gear posts (80, 88, 72), that line would make an angle B=0 degrees (i.e. it would substantially coincide with) with an imaginary horizontal line 82 (FIGS. 7–8) drawn through the longitudinal axis of fixed gear post 88 of center idler gear 86 and being substantially parallel to (elongated) rack 16 and rack 18, as schematically illustrated in FIGS. 7–8. This type of configuration would result in each rack engaging two pinions during operation, i.e., rack 16 would engage second pinion 70 and first pinion 78, and rack 18 would engage first pinion 78 and second pinion 70, respectively, with each rack skipping center idler gear 86, as generally depicted in FIGS. 7–8.

Figure 9:
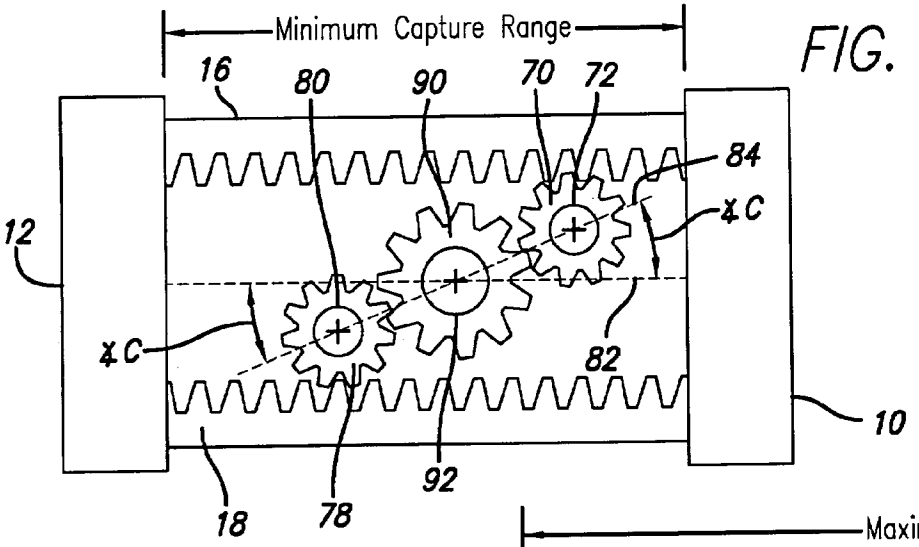
FIG. 9 is a schematic representation of a three-gear rack-and-pinion media guide system showing a minimum media capture range in accordance with another alternative embodiment of the present invention.
Figure 10:
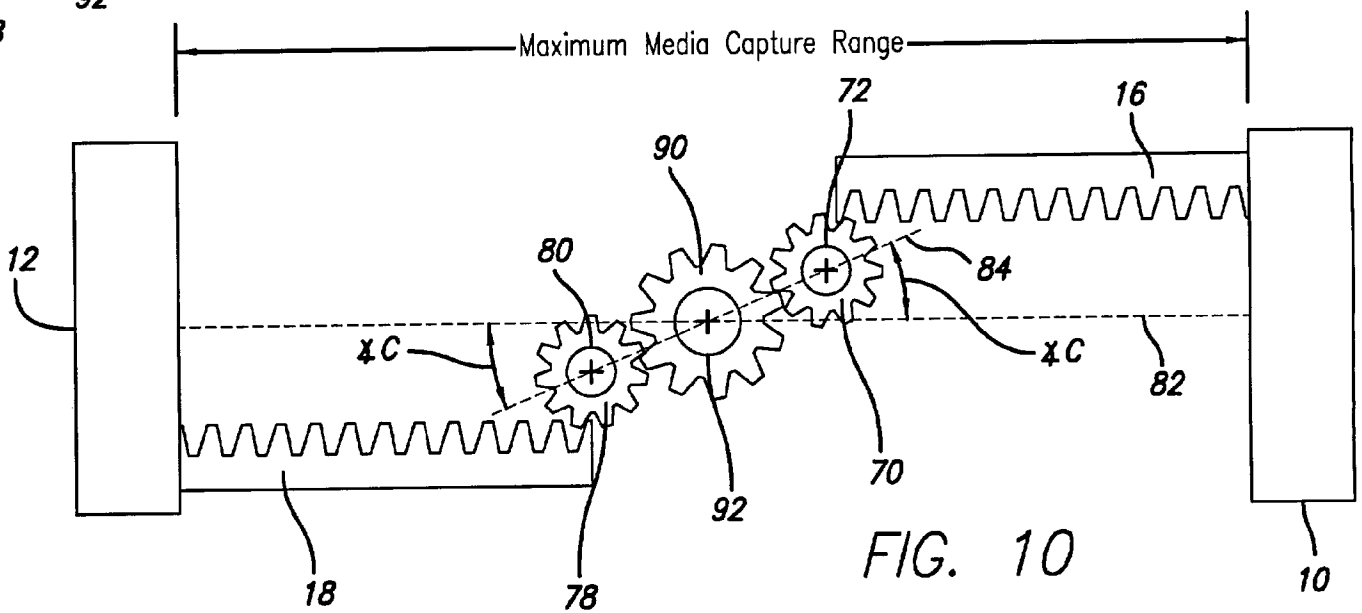
FIG. 10 is a schematic representation of the three-gear rack-and-pinion media guide system of FIG. 9 showing a maximum media capture range.

In accordance with yet another exemplary embodiment of the present invention, the center-justified media guide holder setup of FIGS. 1–2, may be improved to provide a larger maximum media capture range without the need to modify the overall printer design by replacing single central pinion 14 with a three-gear cluster (similar to the gear cluster of FIG. 3) comprising first pinion 78 (which rotates on a fixed post 80), second pinion 70 (which rotates on a fixed post 72), and an idler gear 90 which is rotatably mounted centrally between print media guide members 10, 12 via a fixed post 92, as generally shown in FIGS. 9–10. To prevent each rack (16, 18) from engaging center idler gear 90, which always rotates in an opposite direction relative to first and second pinions (78, 70), during operation, the diameter of center idler gear 90 is made sufficiently larger than the diameter of each of first and second pinions (78, 70), which are substantially of the same diameter, to allow the three fixed gear posts (80, 92, 72) to be axially aligned in a sloped line configuration, as generally shown in FIGS. 9–10. Specifically, if an imaginary line 84 (FIGS. 9–10) were to be drawn through the longitudinal axes (each axis marked with a cross sign, FIGS. 9–10) of the three gear posts (80, 92, 72), that line would make an acute angle C with an imaginary horizontal line 82 (FIGS. 9–10) drawn through the longitudinal axis of fixed gear post 92 of center idler gear 90 and being substantially parallel to (elongated) rack 16 and rack 18, as schematically illustrated in FIGS. 9–10. This type of configuration would result in the longitudinal axis of fixed gear post 80 of first pinion 78 being essentially shifted downwards by angle C and the longitudinal axis of fixed gear post 72 of second pinion 70 being, respectively, shifted upwards by angle C relative to the longitudinal axis of fixed gear post 92 of center gear 90, as schematically illustrated in FIGS. 9–10.

Furthermore, in this sloped line configuration, each rack can only engage its respective pinion during operation, i.e., rack 16 can only engage second pinion 70, and rack 18 can only engage first pinion 78, respectively, with each rack skipping center idler gear 90,, as generally depicted in FIGS. 9–10. Also, acute angle C would generally be somewhat larger than acute angle A of the setup shown in FIGS. 4–6.

A person skilled in the art should readily recognize that by replacing a conventional single center pinion with a central gear cluster in accordance with the general principles of the present invention, the printer manufacturer can not only achieve greater maximum media capture range, but can also gain better rack support due to the pinions being disposed closer (relative to the conventional setup of FIGS. 1–2) to where the print media rolls are being held. This is a significant advantage over prior art print media guide setups as each rack needs to be as rigid as possible to assure reliable operation.

A person skilled in the art would undoubtedly recognize that other variations on the above-described exemplary embodiments (of the present invention) are possible. For example, the three-gear cluster of each of FIGS. 3, 4–6, 7–8, and 9–10 may be replaced with a five-gear cluster, or a seven-gear cluster, or a nine-gear cluster, etc. depending on manufacturer needs and/or application, provided each odd-number gear cluster is adapted to function in accordance with the general principles of the present invention. Also, the longitudinal axes of the fixed posts of the three-gear cluster embodiments described hereinabove do not necessarily have to lie on a straight line. For example, the center idler gear may be made sufficiently thicker than its neighboring first and second pinions to allow an offline mounting of each pinion relative to the center idler gear, i.e. the longitudinal axes of the first pinion, the center idler gear, and the second pinion would lie on a curve.

Other components and/or configurations may be utilized in the above-described embodiments, provided that such components and/or configurations do not depart from the intended purpose and scope of the present invention. While the present invention has been described in detail with regards to the above embodiments, it should be appreciated that various modifications and variations may be made in the present invention without departing from the scope or spirit of the invention. In this regard it is important to note that practicing the invention is not limited to the applications described hereinabove. Many other applications and/or alterations may be utilized provided that such other applications and/or alterations do not depart from the intended purpose of the present invention.

It should be appreciated by a person skilled in the art that features illustrated or described as part of one embodiment may also be used in other embodiments. It is, therefore, intended that the present invention cover all such modifications, embodiments and variations as long as such modifications, embodiments and variations come within the scope of the appended claims and their equivalents.

What is claimed is:

1. A media guide system, comprising:

(a) a first rack operatively coupled to a first media guide member to engage a media;

(b) a second rack disposed opposite said first rack and operatively coupled to a second media guide member to engage the media, said first and second racks adapted to move in a reciprocal fashion relative to each other to afford a maximum media capture range;

(c) at least one central gear cluster operatively coupled between said first and second racks to expand said maximum media capture range, wherein said at least one central gear cluster comprises:

a first pinion adapted to rotate on a first post;

a second pinion adapted to rotate on a second post; and at least one idler gear operatively coupled between said first and second pinions, wherein said at least one idler gear is adapted to rotate on a third post, each of said first, second and third posts having a longitudinal axis, said first rack being operatively coupled to said first pinion and said second rack being operatively coupled to said second pinion, and wherein the diameter of said at least one idler gear is made sufficiently smaller than the diameter of each of said first and second pinions to allow said first, second and third posts to axially align in a sloped line configuration for the purpose of preventing each of said first and second racks from engaging said at least one idler gear during operation, the diameters of each of said first and second pinions being substantially the same, said first rack adapted to engage only said first pinion and said second rack adapted to engage only said second pinion during operation.

2. The media guide system of claim 1, wherein said sloped line configuration is defined by a first imaginary line drawn through the longitudinal axes of said first, second and third posts and making an acute angle with a second imaginary horizontal line drawn through the longitudinal axis of said third post of said at least one idler gear, said second line being substantially parallel to each of said first and second racks.

3. A media guide system, comprising:

(a) a first pinion adapted to rotate on a first post;

(b) a second pinion disposed proximate to said first pinion and adapted to rotate on a second post;

(c) a first rack operatively coupled to said first pinion, said first rack further operatively coupled to a first media guide member to engage a media;

(d) a second rack operatively coupled to said second pinion, said second rack operatively coupled to a second media guide member to engage the media, said first and second racks adapted to move in a reciprocal fashion relative to each other to afford a maximum media capture range; and (e) at least one idler gear operatively coupled between said first and second pinions to form a central gear cluster, said central gear cluster expanding said maximum media capture range, wherein said at least one idler gear is adapted to rotate on a third post, each of said first, second and third posts having a longitudinal axis, and wherein the diameter of said at least one idler gear is made sufficiently smaller than the diameter of each of said first and second pinions to allow said first, second and third posts to axially align in a sloped line configuration for the purpose of preventing each of said first and second racks from engaging said at least one idler gear during operation, the diameters of each of said first and second pinions being substantially the same, said first rack adapted to engage only said first pinion and said second rack adapted to engage only said second pinion during operation.

4. The media guide system of claim 3, wherein said sloped line configuration is defined by a first imaginary line drawn through the longitudinal axes of said first, second and third posts and making an acute angle with a second imaginary horizontal line drawn through the longitudinal axis of said third post of said at least one idler gear, said second line being substantially parallel to each of said first and second racks.

5. A print media guide system, comprising:

(a) a base frame;

(b) a first print media guide member operatively coupled to said base frame and including a first rack;

(c) a second print media guide member operatively coupled to said base frame opposite said first print media guide member and including a second rack, said first and second print media guide members adapted to hold a print media roll mounted therebetween, said first and second racks adapted to move on said base frame in a reciprocal fashion relative to each other to afford a maximum media capture range; and (d) at least one gear cluster disposed substantially centrally between said first and second print media guide members, said at least one gear cluster operatively coupled between said first and second racks to expand said maximum media capture range, wherein said at least one central gear cluster comprises a first pinion adapted to rotate on a first post, a second pinion adapted to rotate on a second post, and at least one idler gear operatively coupled between said first and second pinions, wherein said at least one idler gear is adapted to rotate on a third post, each of said first, second and third posts having a longitudinal axis, said first rack being operatively coupled to said first pinion and said second rack being operatively coupled to said second pinion, and wherein the diameter of said at least one idler gear is made sufficiently smaller than the diameter of each of said first and second pinions to allow said first, second and third posts to axially align in a sloped line configuration for the purpose of preventing each of said first and second racks from engaging said at least one idler gear during operation, the diameters of each of said first and second pinions being substantially the same, said first rack adapted to engage only said first pinion and said second rack adapted to engage only said second pinion during operation.

6. The print media guide system of claim 5, further comprising means for spring loading at least one of said first and second racks relative to said base frame.

7. The print media guide system of claim 6, wherein said spring loading means includes at least one extension spring coupled between at least one of said first and second racks and said base frame.

8. The print media guide system of claim 5, wherein each of said first and second print media guide member further includes a base portion, said base frame including at least two opposing sets of track rails.

9. The print media guide system of claim 8, wherein each base portion is adapted to slide on one of said at least two opposing sets of track rails.

10. The print media guide system of claim 5, wherein said sloped line configuration is defined by a first imaginary line drawn through the longitudinal axes of said first, second and third posts and making an acute angle with a second imaginary horizontal line drawn through the longitudinal axis of said third post of said at least one idler gear, said second line being substantially parallel to each of said first and second racks.

11. The media guide system of claim 1, further comprising means for spring loading at least one of said first and second racks relative to a base frame.

12. The media guide system of claim 11, wherein said spring loading means includes at least one extension spring coupled between at least one of said first and second racks and the base frame.

13. The media guide system of claim 3, further comprising means for spring loading at least one of said first and second racks relative to a base frame.

14. The media guide system of claim 13, wherein said spring loading means includes at least one extension spring coupled between at least one of said first and second racks and the base frame.

15. A media guide system, comprising:

(a) a first rack operatively coupled to a first media guide member to engage a media;

(b) a second rack disposed opposite said first rack and operatively coupled to a second media guide member to engage the media, said first and second racks adapted to move in a reciprocal fashion relative to each other to afford a maximum media capture range; and (c) at least one central gear cluster operatively coupled between said first and second racks to expand said maximum media capture range, wherein said at least one central gear cluster comprises:

a first pinion in communication with said first rack;

a second pinion in communication with said rack; and at least one idler gear operatively coupled between said first and second pinions, wherein the diameter of said at least one idler gear is smaller than the diameter of at least one of said first and second pinions.

16. The media guide system of claim 15, wherein said first pinion is adapted to rotate on a first post, said second pinion is adapted to rotate on a second post, and said idler gear is adapted to rotate on a third post, each of said first, second and third posts having a longitudinal axis.

17. The media guide system of claim 16, wherein the diameter of said at least one idler gear is smaller than the diameter of each of said first and second pinions to allow said first, second and third posts to axially align in a sloped line configuration for the purpose of preventing each of said first and second racks from engaging said at least one idler gear during operation.

18. The media system of claim 17, wherein the diameters of each of said first and second pinions are substantially the same.

19. A print media guide system, comprising:

(a) a base frame;

(b) a first print media guide member operatively coupled to said base frame and including a first rack;

(c) a second print media guide member operatively coupled to said base frame opposite said first print media guide member and including a second rack, said first and second print media guide members adapted to hold a print media roll mounted therebetween, said first and second racks adapted to move on said base frame in a reciprocal fashion relative to each other to afford a maximum media capture range; and (d) at least one gear cluster disposed substantially centrally between said first and second print media guide members, said at least one gear cluster operatively coupled between said first and second racks to expand said maximum media capture range, wherein said at least one central gear cluster comprises:

a first pinion in communication with said first rack;

a second pinion in communication with said rack; and at least one idler gear operatively coupled between said first and second pinions, wherein the diameter of said at least one idler gear is smaller than the diameter of at least one of said first and second pinions.

20. The print media guide system of claim 19, wherein said first pinion is adapted to rotate on a first post, said second pinion is adapted to rotate on a second post, and said idler gear is adapted to rotate on a third post, each of said first, second and third posts having a longitudinal axis.

21. The print media guide system of claim 20, wherein the diameter of said at least one idler gear is smaller than the diameter of each of said first and second pinions to allow said first, second and third posts to axially align in a sloped line configuration for the purpose of preventing each of said first and second racks from engaging said at least one idler gear during operation.

22. The print media system of claim 19, wherein the diameters of each of said first and second pinions are substantially the same.

* * * * *